United States Patent [19]

Nunn et al.

[11] Patent Number: 4,980,837

[45] Date of Patent: Dec. 25, 1990

[54] CIRCUIT AND METHOD FOR AUTOMATICALLY SWEEPING THROUGH A PLURALITY OF SIREN MODES

[76] Inventors: Ewing D. Nunn, 5060 Via del Fierro, Yorba Linda, Calif. 92686; Francis H. Gerhard, P.O. Box 1079, Pine Valley, Calif. 92062

[21] Appl. No.: 244,277

[22] Filed: Sep. 15, 1988

[51] Int. Cl.[5] ..... G10K 7/00

[52] U.S. Cl. ..... 364/484; 116/147; 340/384 E; 340/384 R

[58] Field of Search ..... 364/484; 340/384 R, 340/384 E, 405; 116/147

[56] References Cited

U.S. PATENT DOCUMENTS

| | | | |
|---|---|---|---|
| 3,868,684 | 2/1975 | Nunn, Jr. | 340/384 E |
| 4,040,050 | 8/1977 | Nunn, Jr. | 340/384 E |
| 4,054,869 | 10/1977 | Smith et al. | 340/384 R |

FOREIGN PATENT DOCUMENTS

| | | | |
|---|---|---|---|
| 3740000 | 6/1988 | Fed. Rep. of Germany | 116/147 |

OTHER PUBLICATIONS

Marston et al., "Multi-Option Siren"; ETI, vol. 10; Jan. 1981, pp. 22-24.

*Primary Examiner*—Parshotam S. Lall
*Assistant Examiner*—Ellis B. Ramirez
*Attorney, Agent, or Firm*—George F. Bethel; Patience K. Bethel

[57] ABSTRACT

A distinguishable siren sound pattern is produced within an emergency vehicle by automatically alternating the siren sound pattern from among a plurality of distinguishable types of separate siren sound patterns. One of said plurality of distinguishable type of sound patterns may be continuously generated or alternatively through momentary contact in a horn switch, automatically swept among a plurality of the distinguishable siren sound patterns according to a predetermined pattern. In the illustrated embodiment wail, yelp, high-low or hetro siren sound patterns are producible either through microprocessor control or through discretely switched waveform generators. The siren sound pattern is automatically alternated between wail and yelp or between high-low and hetro according to manually switch configurations and momentary activation of a horn ring switch. Repeated activation of the horn ring switch toggles the circuit between a selected continuous siren sound pattern such as a continuous wail or high-low and between an alternating sound pattern as is described.

21 Claims, 3 Drawing Sheets

CIRCUIT AND METHOD FOR AUTOMATICALLY SWEEPING THROUGH A PLURALITY OF SIREN MODES

BACKGROUND OF THE INVENTION

1. Field of the Invention

The invention relates to the field of control devices and methodologies for controlling emergency sirens and in particular to a control device and methodology which automatically sweeps a siren through a plurality of siren sounds.

2. Description of the Prior Art

Ambulance, fire engines, police and other emergency sirens commonly employ a variety of siren sound patterns for various purposes. These sound patterns typically differ in the frequencies and range covered as well as the timing of frequency variations. For example, the sound pattern normally thought of as the classic "wail" starts at 500 Hz, slowly rises to about 1650 Hz and then even more slowly returns to 500 Hz in a period of approximately five seconds. The European "high-low" sound alternates between a low tone of 650 Hz and a high tone of 1300 Hz with a period of about 0.5 second at each tone.

Periodically alternating between two or more different siren sounds has been found to be a more startling stimulus to bystanders and other drivers than simply using a single sound pattern. It has been found, for example, that wail and even the more rapid "yelp", which is a quickly repeated wail, becomes monotonous and provides a much lower stimulus when continually repeated.

For this reason, drivers of emergency vehicles frequently alternate between two or more sounds such as "wail", "yelp", and "hi-low". However, current methodologies require a rather cumbersome manual switching between sounds by turning a rotary switch, pressing pushbutton switches, or by depressing a horn ring as described in greater detail in "Emergency Vehicle Siren Switching Apparatus," U.S. Pat. No. 3,868,684 (1975), and "Emergency Vehicle Audio Warning System," U.S. Pat. No. 4,040,050 (1977).

Such manual switching of the siren sounds distracts the operator from attention which he should otherwise be directing to the control of the vehicle. As can be readily understood, manually manipulating variations in siren sounds through a rotary switch, pushbutton switches or even by tapping a horn ring is distracting to the operator, who is concentrating on difficult and potential dangerous traffic congestion.

Therefore, what is needed is a circuit and methodology which provides the benefits of switching a siren through a plurality of siren sounds without being subject to the defects or distractions required by prior art systems.

BRIEF SUMMARY OF THE INVENTION

A method of producing an audible siren signal comprising the steps of setting at least one switch to a selected one of a plurality of positions, and selectively generating a first frequency envelope for an audible siren signal during a corresponding first determined time period.

Subsequently a second frequency envelope is selectively and automatically generated during a corresponding second time period. The steps of selectively generating the first and second frequency envelopes is automatically repeated during additional corresponding first and second time periods.

As a result, at least two distinguishable siren signals are producible without continued operator intervention.

The first frequency envelope is selected from a plurality of distinguishable frequency envelopes depending upon the step of setting the at least one switch.

The second frequency envelope is selected from a plurality of distinguishable frequency envelopes depending upon the step of setting the at least one switch.

The method further comprises the step of producing an audible siren signal in accordance to the first and second frequency envelope selectively generated during the corresponding first and second time periods.

The method further comprises the step of selectively disabling generation of one of first and second frequency envelopes during the corresponding first and second time periods and selectively and continuously generating the other one of the first and second frequency envelopes.

The step of selectively generating the first frequency envelope during the corresponding first time period comprises the step of exponentially increasing the frequency of the siren signal from a first frequency magnitude to a second frequency magnitude during a first subperiod and then exponentially decreasing the frequency of the siren signal at a lower rate from the frequency magnitude to the first frequency magnitude during a second time subperiod.

The step of increasing the siren signal increases the siren signal from 500 Hz to 1650 Hz within one second, continuing the siren signal at the 1650 Hz for approximately 0.5 seconds and then decreasing the siren signal back to 500 Hz during 3.75 seconds. Alternatively, the step of increasing the the siren signal increases the siren signal from 500 Hz to 1650 Hz within 2.2 milliseconds, continues the siren signal at said 1650 Hz for approximately 1.1 milliseconds and then decreases the siren signal back to 500 Hz during approximately 8.4 milliseconds to yield an air horn sound.

In an alternative embodiment, the step of exponentially increasing and decreasing the siren signal comprises increasing the siren signal from a first frequency at 500 Hz to a second frequency at 1650 Hz during a first time period of approximately 0.94 seconds, continuing the siren signal at 1650 Hz for approximately 0.13 seconds and then decreasing the siren signal back to 500 Hz during the second time period of approximately 0.94 seconds.

In yet another embodiment the siren signal is alternated in a square wave envelope of approximately 50 percent duty cycle between a first frequency magnitude and a second frequency magnitude.

In the step of alternating the siren signal between the first and second frequency magnitudes, the siren signal begins at approximately 650 Hz and is abruptly raised after 0.5 seconds to 1300 Hz, continues approximately 0.5 seconds at 1300 Hz, and is then abruptly reduced to 650 Hz.

In the step of generating the square wave, the siren signal begins at 650 Hz, continues at 650 Hz for approximately 0.13 seconds, is abruptly raised to 1300 Hz., continues at 1300 Hz for approximately 0.13 seconds, and then is abruptly reduced to 650 Hz.

The invention is also a method of generating a siren signal comprising the steps of generating a first siren signal of a first type during a corresponding first period, and generating a second siren signal of a second type during a corresponding second period. The steps of generating the first type and the second type of siren signal are automatically alternating.

As a result, an attention-getting siren is automatically generated without continued operator intervention.

The step of automatically alternating between generating the first and second types of siren signals is selectively enabled by momentary contact of a switch.

The invention is still further characterized as a circuit for generating a distinguishable siren signal comprising a first circuit for storing a plurality of mode commands. A second circuit scans the plurality of mode commands stored within the first circuit. The second circuit is coupled to the first circuit. A third circuit generates an audio signal having a predetermined time dependent frequency. A fourth circuit selects one of the plurality of audio signals according to a selected one of the mode commands stored within the first circuit for storing as scanned by the second circuit for scanning. The fourth circuit is coupled to the second circuit for scanning and the third circuit for generating.

As a result, a plurality of distinguishable audible signals is automatically generated without continued operator intervention.

The first circuit for storing the plurality of mode commands comprises a corresponding plurality of switches.

In one embodiment, the second, third and fourth circuit comprise a microprocessor with memory. The microprocessor has inputs coupled to the first circuit. The inputs are scanned pursuant to programmed control stored within the memory. The plurality of distinguishable siren signals are generated pursuant to program control within the memory within the microprocessor. The microprocessor selects among the plurality of stored siren sound patterns stored within the memory.

The third circuit for generating the plurality of distinguishable siren sound patterns is corresponding plurality of waveform generators. Each waveform generator is particularly arranged and configured to generate a corresponding unique siren sound pattern. The fourth circuit for automatically alternating among the selected plurality of siren sound patterns comprises a periodically selectively driven switching circuit for switching among the plurality of waveform generators.

The invention can better be visualized by now turning to the following drawings wherein like elements are referenced by like numerals.

Figure 1:
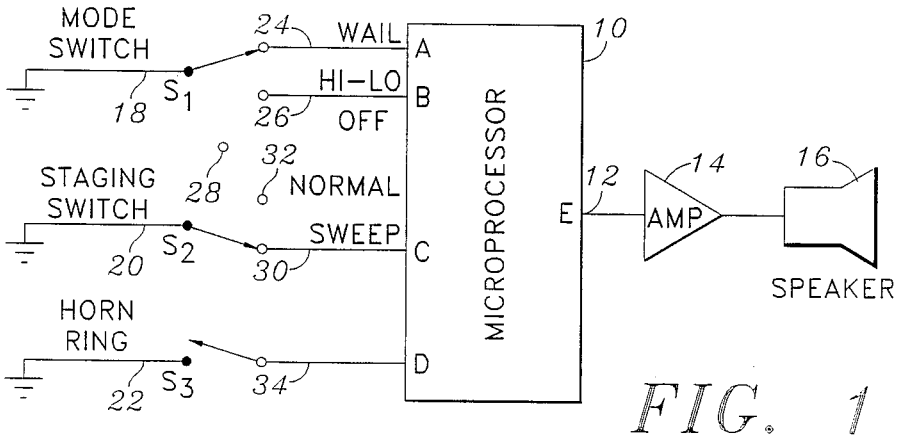
FIG. 1 is a diagrammatic block diagram of a microprocessor wherein the methodology of the present invention is implemented.
Figure 2:
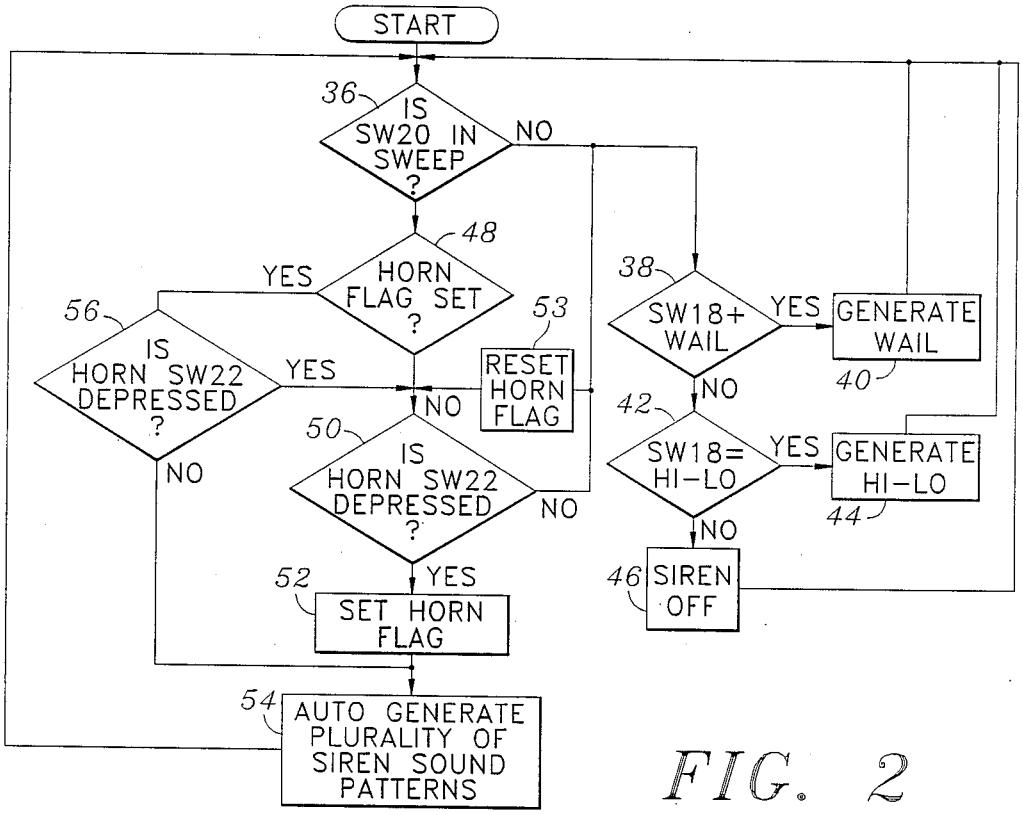
FIG. 2 is a flow diagram of the methodology which is implemented in the microprocessor of FIG. 1.

FIGS. *3a–e* are waveform diagrams illustrating an a plurality of distinguishable siren sound patterns and an automatic sweep through the siren sound patterns which can be effectuated by the circuitry and methodology of FIGS. 1 and 2, respectively.

Figure 4:
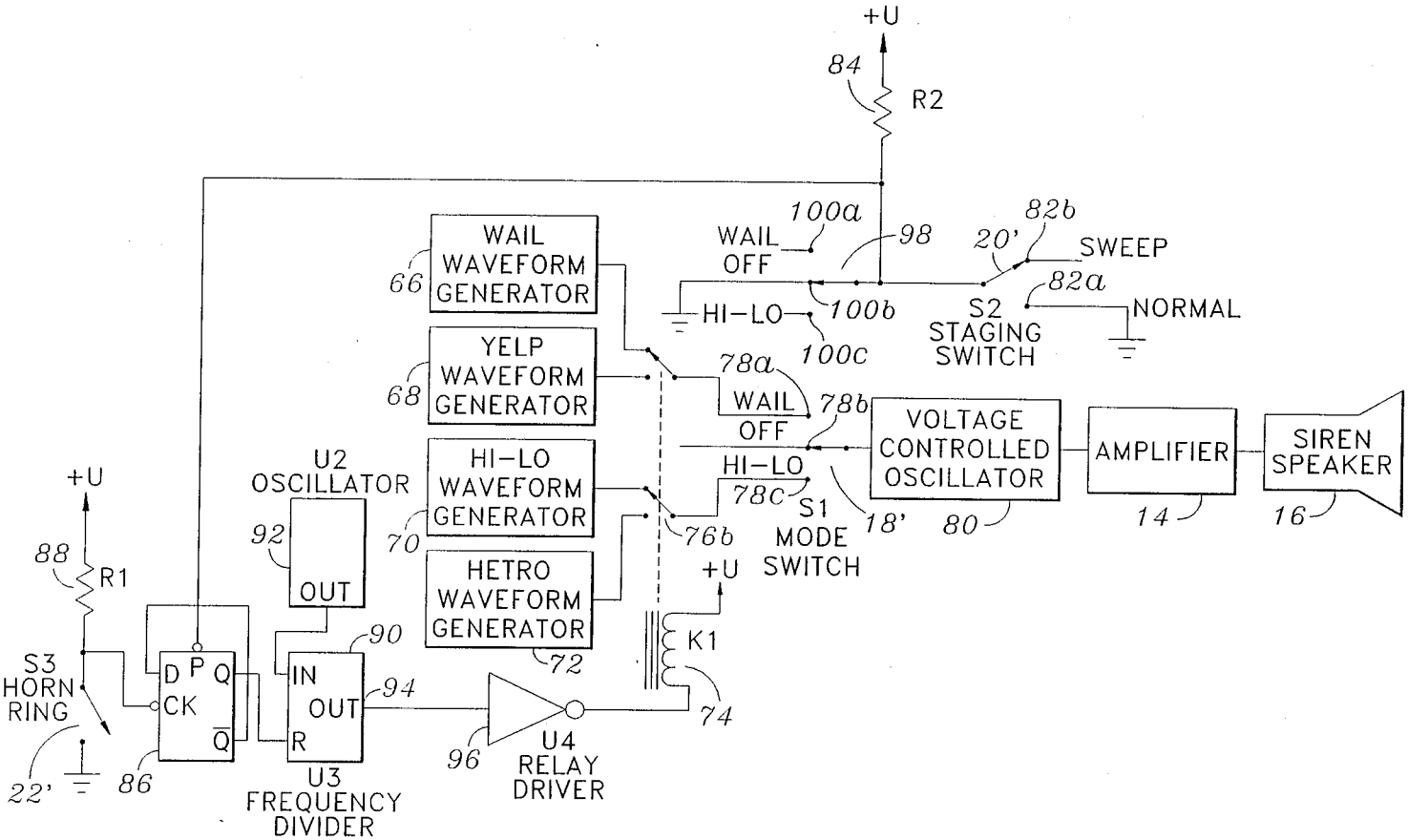

FIG. 4 is a diagrammatic block diagram of an alternative embodiment of a circuit wherein the invention is implemented.

The invention and its various embodiments may be better understood by now turning to the following detailed description.

DETAILED DESCRIPTION OF THE PREFERRED EMBODIMENTS

The distinguishable siren sound pattern is produced within an emergency vehicle by automatically alternating the siren sound pattern from among a plurality of distinguishable types of separate siren sound patterns. One of said plurality of distinguishable types of sound patterns may be continuously generated or alternatively through momentary contact in a horn switch, automatically swept among a plurality of the distinguishable siren sound patterns according to a predetermined pattern. In the illustrated embodiment wail, yelp, high-low or hetro siren sound patterns are producible either through microprocessor control or through discretely switched waveform generators. The siren sound pattern is automatically alternated between wail and yelp or between high-low and hetro according to manually switch configurations and momentary activation of a horn ring switch. Repeated activation of the horn ring switch toggles the circuit between a selected continuous siren sound pattern such as a continuous wail or high-low and between an alternating sound pattern as is described.

Turn now to FIG. 1 which is a block diagram of a microprocessor system in which the methodology of the invention is implemented. The method periodically alternates between a plurality of siren sound patterns without requiring any corresponding input from the operator. A conventional microprocessor 10 is used to generate a square wave output signal at output terminal 12. All the siren patterns are comprised of square wave signals with the frequency being controlled and varied as a function of time. The output signal is coupled from output 12 of microprocessor 10 to a conventional power amplifier 14. Amplifier 14 in turn drives a speaker or siren 16.

Microprocessor 10 is provided with at least three switched inputs generated by selectively grounding an input through either switch 18, 20 or 22. In the illustrated embodiment, switch 18 is a three-position rotary switch which selects one of two basic sound patterns, namely the wail pattern when switched to terminal 24 or the high-low pattern when switched to terminal 26. The sound patterns are more specifically illustrated and described below in connection with FIG. 3.

When switched to terminal 28, switch 18 is in the off position. Staging switch 20 and horn ring switch 22 are utilized to implement a sweep feature described below. For example, connection of switch 20 to sweep terminal 30 causes a microprocessor to implement the sweep methodology as described in greater detail in connection with FIG. 2 while setting the switch at terminal 32 allows the siren pattern to be output in a normal mode.

Similarly, momentary contact through horn ring 22 will temporarily ground input 34 of microprocessor 10 to provide and additional operator input mode.

Input 24–34, where actively connected to microprocessor 10, each has a pullup resistor (not shown) coupled to the positive power supply within the general microprocessor circuitry (also not shown). Closure of any one of the switches 18–22 drops the logic level at the corresponding connected input low, otherwise each input is pulled high to its respective pullup resistor.

Micrprocessor 10 scans inputs 24–26, 30 and 34 to determine the status of the input switches. For example, if mode switch 18 were connected to the wail input 24, with staging switch 20 and horn ring 22 nonactivated, microprocessor 10 will read a 0111 input word at inputs 24, 26, 30 and 34. The input word will change according to the position of switches 18 and 22 as exemplified by the foregoing example.

Therefore, according to a prestored program contained within resident memory included as part of microprocessor 10 and depending upon the status of the input word selected, programs may be implemented to output predetermined and varying sound patterns through amplifier 14 to siren 16 as described in greater detail in connection with FIGS. 2 and 3.

Turn now to FIG. 2 wherein a simplified embodiment of the methodology of the invention is illustrated in a flow diagram as implemented in the microprocessor of FIG. 1. The methodology begins with step 36 wherein the value of input 30 of microprocessor 10 from staging switch 20 is tested. If staging switch 20 is set in its normal mode as determined at step 36, the program branches to step 38 wherein the value of mode switch 18 is tested, namely inputs 24 and 26. If input 24 corresponding to the wail sound pattern has been selected as determined at step 38, the wail sound pattern will be continuously generated beginning at step 40 as depicted in the wave form diagram of FIG. 3 with scanning control returning to step 36 to scan the value of staging switch 20.

However, whether mode switch 18 is set to wail or high-low will be determined at step 42. If input 26 is active low, the high-low sound pattern will then be continuously generated at step 44 with the scanning process again returning to test the condition of staging switch 20.

In the event that neither inputs 24 or 26 are selected corresponding to wail and high-low respectively, the assumption will be made at step 46 that the siren is off with control returning again to scan staging switch 20 at step 36.

If, however, staging switch 20 is set to the sweep pattern, i.e. input 30 active low, program control will then determine at step 48 whether an internal horn flag has been set signifying a previous closure of horn ring switch 22. If the horn ring has not previously been depressed, its then current status is tested at step 50. If horn ring switch is not depressed at the time of execution of step 50, then operation is branched to step 38 at which point a continuous wail or continuous high-low siren or siren-off condition is implemented as described above.

However, if at step 50 horn ring switch 22 is depressd, then the internal horn flag is set at step 52 and a predetermined plurality of siren sound patterns is automatically and continuously generated at step 54. For example, with mode switch 18 set in the wail position, two alternating sounds may be produced, such as one cycle of wail followed by five cycles of yelp as depicted in FIG. 3. If mode switch 18 instead were in the high-low position with input 26 active low, then at step 54 an alternating sound pattern would be continuously and automatically generated, alternating between the high-low sound output and some other distinguishable sound pattern such as yelp or hetro, again described below. In any case, the scanning continues by returning to step 36.

If at some point during the continuous scanning of the status of switches 18–22, it is found at step 48 that the horn flag has been set after it has been determined at step 36 that staging switch 20 is in the sweep mode, then it is determined at step 56 whether or not horn switch 22 is then currently depressed. If horn switch 22 is not depressed at the time of execution of step 56, operation continues with step 54 as described above. However, if horn switch 22 is depressed at the time of execution of step 56, the horn flag is reset at step 53 and operation is branched to step 38 wherein nonalternating siren patterns are generated as described in connection with steps 38–46. Therefore, when in the sweep mode, depressing horn switch 22 alternately toggles in or out the automatically alternating siren sound patterns generated at step 54 according to the then current position of mode switch 18.

Figure 3C:
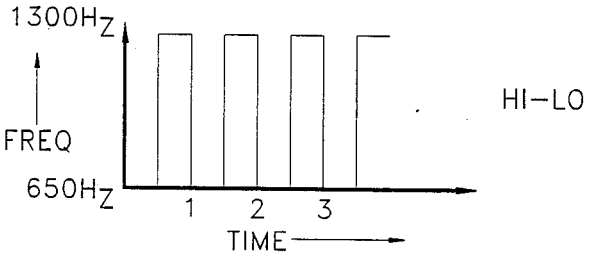
Figure 3D:
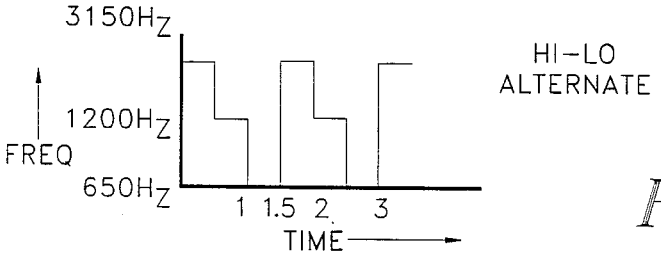
Figure 3E:
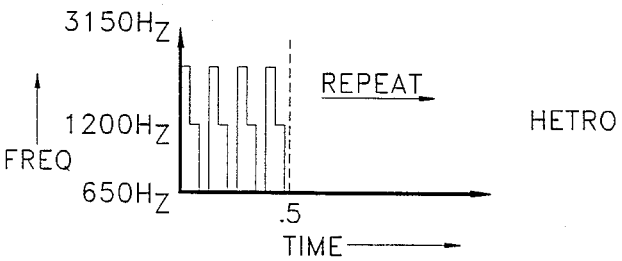
Figure 3A:
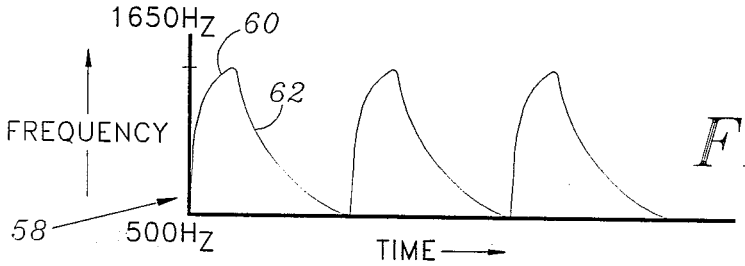
Figure 3B:
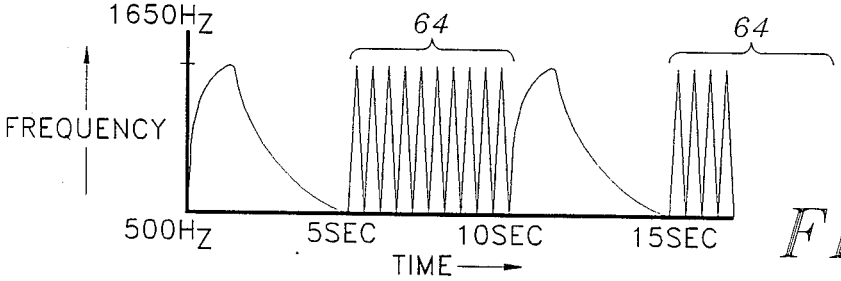

Turn now to FIGS. 3*a–b* herein the wail, yelp and alternating wail and yelp sound patterns described above are graphically depicted in a time waveform. FIG. 3*a* is a waveform graph wherein the vertical axis is frequency and the horizontal axis is time. The waveform depicted in FIG. 3*a* is the wail waveform which starts at the beginning of a period 58 at 500 Hz, rises exponentially to a maximum of 1650 Hz as depicted by line segment 60. The rise time of portion 60 is approximately one second with a hang time at 1650 Hz of approximately 0.5 seconds. Thereafter the frequency decreases as depicted by line segment 62 during a fall time of 3.75 seconds for total period of 5.25 seconds with a group repetition rate of a sound pattern of 0.19 Hz.

The yelp sound pattern depicted in wave portions 64 of FIG. 3*b* is identical in individual pulse shape to that of the wail pattern of FIG. 3*a* with the exception that the group repetition rate is 4 Hz with rise, fall and hang times proportionately reduced. FIG. 3*b* illustrates one possible example of the alternating plurality of siren patterns which may be generated at step 54 of FIG. 2. In FIG. 3*b* a single period of wail is alternated between five seconds of yelp.

The high-low or European siren sound pattern described above is illustrated in FIG. 3*c* as hanging at 650 Hz for 0.5 seconds and then increasing almost instantaneously to 1300 Hz where it stays for an additional 0.5 seconds.

An alternative high-low pattern is illustrated in FIG. 3*d* which begins at 3150 Hz for 0.5 seconds and then drops almost instantaneously to 1200 Hz for 0.5 seconds and then almost instantaneously drops to 650 Hz for 0.5 seconds for a total cycle period of 1.5 seconds.

The sound pattern, hetro, is identical to the sound pattern of FIG. 3*d* with the exception that the group repetition rate is increased by a factor such that the four periods of pattern illustrated in FIG. 3*d* are repeated during each 0.5-second interval as graphically depicted in FIG. 3*e*.

Therefore, in the illustrated embodiment it must be understood that many more microprocessor input ports may be provided with more siren sounds than are discussed in connection with the flow diagram of FIG. 2. In addition, horn ring switch 22 may be used for other purposes such as yelp override as described in "Emergency Vehicle Audio Warning System," U.S. Pat. No. 4,040,050 (1977) when staging switch 20 is connected to normal terminal 32.

Turn now to the alternative embodiment of FIG. 4 wherein the microprocessor circuitry of FIG. 1 is replaced by descrete logic and analog circuitry. In the custom circuit of FIG. 4, each of the waveforms which are automatically alternated through siren 16 are generated by a separate waveform generator. For example, wail generated by a wail waveform generator 66, yelp is generated by a yelp waveform generator 68, high-low by a high-low waveform generator 70 and hetro by waveform generator 72. The outputs of generators 66–72 are coupled through a relay 74 having relay contacts 76a and 76b. Alternatively, a solid state switching circuit or multiplexer could be equivalently substituted. The outputs from relay contacts 76a and 76b are then coupled to terminals 78a, 78b and 78c of mode switch 18'. The siren sound pattern is generated by a voltage controlled oscillator 80 having its input coupled to the output contact of mode switch 18'. The output of voltage controlled osciallator 80 is coupled to amplifier 14 and then in turn to siren 16. The frequency variation output from oscillator 80 is controlled according to waveform generators 66–72 which are selected by means of relay 74 and contact 76a and 76b, mode switch 18', horn ring 22' and staging switch 20'.

When staging switch 20' is switched to contact normal terminal 82a, the sweep function will not be generated and a single siren sound pattern will be output from the circuit of FIG. 4. Staging switch 20' is either grounded to active low for normal or pulled to high to sweep through pullup resistor 84 to the active low preset input of D-type flip-flop 86. Therefore, as long as staging switch 20' is coupled to normal terminal 82a, preset terminal to flip-flop 86 is held low and the Q output of flip-flop 86 is similarly held high. However, when staging switch 20' is moved to the sweep position, the preset input goes inactive high allowing flip-flop 86 to be clocked active low by a momentary closure of horn ring 22. Otherwise the clock input of flip-flop 86 is held high through pullup resistor 88. The inverted Q output of flip-flop 86 is fed back to the D input so that flip-flop 86 toggles upon every momentary depression of horn ring 22'.

The output of flip-flop 86 is coupled to the resest input of a frequency divider 90. The input of frequency divider 90 in turns is coupled to the output of an oscillator 92. With flip-flop 86 in the rest state upon closure of horn ring 22', frequency divider 90 is activated and counts a predetermined number of pulses from oscillator 92. Frequency divider 90 will thus then time out at a predetermined time period, such as five seconds, at which point its output 94 goes high. Relay driver 96 then drives relay 74, thereby moving contacts 76a and 76b into the down position. Then, depending upon the position of mode switch 18', whether in the wail position 78a, off position 78b or high-low position 78c, either a wail or yelp waveform will be delivered to voltage controlled oscillator 80 through terminal 78 or a high-low or a hetro waveform delivered to voltage control oscillator 80 through terminal 78c. At the end of another five-second period, output 94 of frequency divider 90 again goes high thereby de-energizing relay 74, allowing contacts 76a and 76b to be electromechanically reset by spring action or an equivalent electronic means, thereby alternating the waveform coupled through mode switch 18'.

Mode switch 18' is ganged to switch 98 which has an unconnected wail terminal, and high-low terminal and a grounded, off terminal. The positions of wail terminal 100, off terminal 100b and high-low terminal 100c correspond to terminals 78a–78c of mode switch 18'. Therefore, when mode switch 18' is placed in the mid or off position 78b, terminal 100b will also be coupled through switch 98 to the active low preset terminal flip-flop 86. Therefore, flip-flop 86 will hold Q high and frequency divider 90 will be disabled whenever mode switch 18' is in the off position.

However, during a sweep operation with mode switch 18' set in either wail or high-low, a momentary closure of horn ring switch 22' will cause flip-flop 86 to toggle, thereby stopping counter 90 and disabling relay 74. Contacts 76a and 76b will then return to wail or high-low and remain there in a continuous state until the subsequent activation of horn ring 22'. The subsequent activation of horn ring 22' will again toggle flip-flop 86, activate frequency divider 90 and after five seconds turn on relay 74 for an alternating siren output.

Waveform generators 66–72 are conventional tone generators which generate the time envelopes of the respective siren patterns as described above. The only difference among generators 66–72 is a change in the value of the capacitance within such conventional circuits to alter group repetition rate as, for example, from wail to yelp and from high-low to hetro. Control signals within waveform generators 66–72 are also altered according to conventional design principles to change the waveform shape as from the exponential shape of wail and yelp to the square wave envelope of high-low and hetro as depicted in FIGS. 3a–3e.

Similarly, amplifier 14 is a conventional design taking its input from the output of a voltage controlled oscillator through transistorized preamplifier states and thence coupled through a transformer into a push-pull power amplifier which drives siren 16 through an output transformer.

Voltage controlled oscillator 80 is similarly conventional and generates a square wave output with a frequency as determined by the voltage inputs selectively provided to it from the appropriate waveform generators 66–72.

Many modifications and alterations may be made by those having ordinary skill in the art without departing from the spirit and scope of the invention. For example, the siren waveforms, times, durations, frequencies and the other siren sound parameters may be altered within the teaching the invention without departing from its scope. One siren sound which is utilizered is an electronic air horn which has the waveform of the wail sound but with a higher or exaggerated reptition rate. One electronic air horn has the same frequency envelope as the wail, namely 500 Hz increasing to 1650 Hz and decaying back to 500 Hz, but with a group repetition rate of 85 Hz instead of 12 times per minutes.

We claim:

1. A method of automatically producing a series of audibly distinct siren signals to form a composite siren signal comprising the steps of:

setting at least one switch to a selected one of a plurality of positions;

selectively generating a first mode of siren signal during a corresponding first determined time period;

subsequently, selectively and automatically generating a second mode of siren signal during a corresponding second time period;

automatically repeating said steps of selectively generating said first and second modes of siren signals during additional corresponding first and second time periods, said first and second modes of siren signals being readily audibly distinguished from each other, whereby at least two distinguishable siren signals are producible without continued operator intervention.

2. The method of claim 1 where in said step of selectively generating said second mode, said second mode is selected from a plurality of distinguishable modes depending upon said step of setting said at least one switch.

3. The method of claim 1 further comprising the step of producing a composite audible siren signal in accordance to said first and second modes selectively generated during said corresponding first and second time periods.

4. The method of claim 1 further comprising the step of selectively disabling generation of one of first and second modes during said corresponding first and second time periods and selectively and continuously generating the other one of said first and second modes.

5. The method of claim 1 where in said step of selectively generating said first mode, said first mode is selected from a plurality of distinguishable modes depending upon said step of setting said at least one switch.

6. The method of claim 5 where in said step of selectively generating said second mode, said second mode is selected from a plurality of distinguishable modes depending upon said step of setting said at least one switch.

7. The method of claim 5 further comprising the step of selectively disabling generation of one of first and second modes during said corresponding first and second time periods and selectively generating the other one of said first and second modes continuously.

8. The method of claim 6 further comprising the step of selectively disabling generation of one first and second modes during said corresponding first and second time periods and selectively generating the other one of said first and second modes continuously.

9. The method of claim 1 wherein said step of selectively generating said first mode during said corresponding first time period comprises the step of exponentially increasing the frequency of said siren signal for a first frequency magnitude to a second frequency magnitude during a first subperiod and then exponentially decreasing the frequency of said siren signal at a lower rate from said frequency magnitude of said first frequency magnitude during a second time subperiod.

10. The method of claim 9 where said step of increasing said siren signal increases said siren signal from 500 Hz to 1650 Hz within one second, continuing said siren signal at said 650 Hz for approximately 0.5 seconds and then decreasing said siren signal back to 500 Hz during 3.75 seconds to yield a wail sound.

11. The method of claim 9 where said step of increasing said siren signal increases said siren signal from 500 Hz to 1650 Hz within 2.2 milliseconds, continuing said siren at said 1650 Hz for approximately 1.1 milliseconds and then decreasing said siren signal back to 500 Hz during approximately 8.4 milliseconds to yield an air horn sound.

12. The method of claim 9 said step of exponentially increasing and decreasing said siren signal, increases said siren signal from a first frequency at 500 Hz to a second frequency at 1650 Hz during a first time period of approximately 0.94 seconds, continuing said siren signal at 1650 Hz for approximately 0.13 seconds and then decreasing said siren signal back to 500 Hz during said second time period of approximately 0.94 seconds to yield a yelp sound.

13. The method of claim 1 where in said step generating said second frequency envelope during said second time period said siren signal is alternated in a square wave envelope of approximtely 50 percent duty cycle between a first frequency magnitude and a second frequency magnitude.

14. The method of claim 13 where in said step of alternating said siren signal between said first and second frequency magnitudes, said siren signal begins at approximately 650 Hz and is abruptly raised after 0.5 seconds to 1300 Hz, continues approximately 0.5 seconds at 1300 Hz and is then abruptly reduced to 650 Hz to yield a hi-lo sound.

15. The method of claim 13 where in said step of generating said square wave, said siren signal begins at 650 Hz, continues at 650 Hz for approximately 0.13 seconds, is abruptly raised to 1300 Hz, continues at 1300 Hz for approximately 0.13 seconds, and then is abruptly reduced to 650 Hz.

16. A method of generating a composite siren signal comprising the steps of:

generating a first mode of siren signal of a first type during a corresponding first period;

generating a second mode of siren signal of a second type during a coresponding second period, said first and second modes of siren signals being readily distinguishable; and automatically alternating between said steps of generating said first mode and said second mode of siren signal, whereby an attention-getting siren is automatically generated without continued operator intervention.

17. Th method of claim 16 wherein said step of automatically alternating between generating said first and second modes of siren signals is selectively enabled by momentary contact of a switch.

18. A circuit for generating a distinguishable siren signal comprising:

first means for storing a plurality of mode commands, each corresponding to separate combinations of siren modes;

seconds means for automatically scanning said plurality of mode commands stored within said first means for storing, said second means for scanning coupled to said first means for storing;

third means for automatically generating a combination of siren modes;

fourth means for automatically selecting at least two of said plurality of distinguishable siren modes according to a selected one of said mode commands stored wtihin said first means for storing as scanned by said second means for scanning, said fourth means for selecting being coupled said second means for scanning and said third means for generating, whereby a plurality of distinguishable audible signals is automatically generated without continued operator intervention.

19. The circuit of claim 18 wherein said first means for storing said plurality of mode commands comprises a corresponding plurality of switches.

20. The circuit of claim 18 wherein said second, third and fourth means comprise a microprocessor with memory, said microprocessor having inputs coupled to said first means, said inputs being scanned pursuant to programmed control stored within said memory, said plurality of distinguishable siren modes being generated pursuant to program control within said memory within said microprocessor, said microprocessor selecting among said plurality of stored siren sound patterns stored within said memory.

21. The circuit of claim 18 wherein said third means for generating said plurality of distinguishable siren sound patterns is a corresponding plurality of waveform generators, each waveform generator particularly arranged and configured to generate a corresponding unique siren sound pattern and wherein said fourth means for automatically alternating among said selected plurality of siren sound patterns comprises a periodically selectively driven switching means for switching among said plurality of waveform generators.

* * * * *